United States Patent [19]

Schmitt et al.

[11] 4,336,694

[45] Jun. 29, 1982

[54] SPRAYING SYSTEM FOR CRYOGENIC COOLANTS

[75] Inventors: Georg Schmitt, Höllriegelskreuth; Georg Göstl, Neufahrn, both of Fed. Rep. of Germany

[73] Assignee: Linde Aktiengesellschaft, Höllriegelskreuth, Fed. Rep. of Germany

[21] Appl. No.: 122,248

[22] Filed: Feb. 19, 1980

[30] Foreign Application Priority Data

Feb. 20, 1979 [DE] Fed. Rep. of Germany ..... 2906480
Feb. 20, 1979 [DE] Fed. Rep. of Germany ..... 2906488

[51] Int. Cl.[3] ..... F25D 17/02

[52] U.S. Cl. ..... 62/374; 62/380; 239/568; 239/597

[58] Field of Search ..... 62/63, 55, 51, 48, 374, 62/380; 239/568, 597, 599, 601

[56] References Cited

U.S. PATENT DOCUMENTS

| | | | |
|---|---|---|---|
| 3,295,563 | 1/1967 | Laya et al. | 62/55 |
| 3,296,809 | 1/1967 | Feuerstein | 62/55 |
| 3,427,820 | 2/1969 | Hart | 62/374 |
| 3,754,710 | 8/1973 | Chimura | 239/597 |
| 3,845,635 | 11/1974 | Perkins | 62/51 |
| 4,058,262 | 11/1977 | Burnham | 62/64 |
| 4,075,869 | 2/1978 | Fitsall | 62/374 |
| 4,103,507 | 8/1978 | Benois | 62/381 |

*Primary Examiner*—Ronald C. Capossela
*Attorney, Agent, or Firm*—Karl F. Ross

[57] ABSTRACT

A spraying system for cryogenic liquid, e.g. a liquefied gas, provides a distribution duct formed with a plurality of slit-shaped spraying orifices. Preferably a phase separator is provided upstream of the orifices and the orifices are close to the liquid compartment of the phase separator.

11 Claims, 5 Drawing Figures

SPRAYING SYSTEM FOR CRYOGENIC COOLANTS

FIELD OF THE INVENTION

Our present invention relates to a spraying system for cryogenic coolants and, more particularly, to a cryogenic spraying apparatus for chilling materials to be subjected to deep freezing.

BACKGROUND OF THE INVENTION

It has been proposed heretofore to provide an apparatus for contacting material to be deep frozen with cryogenic coolant, generally a liquefied gas such as liquid nitrogen, to effect rapid bulk reduction in temperature as part of a preserving, embrittling or like process.

These techniques have been used, for example, for embrittling materials such as elastomers and synthetic resins in conjunction with a comminuting step enabling the materials to be reused, for the deep freezing of comestibles for preserving them directly or in conjunction with freeze drying, and for the preserving of biological specimens with a minimum of cell denigration.

A spraying system which utilizes an insulated freezing chamber with a transport means for the material to be deep frozen is described, for example, in U.S. Pat. No. 4,103,507 issued Aug. 1, 1978.

This system provides an insulated freezing chamber through which the product to be contacted with the sprayed cryogen is introduced through an inlet opening and is transported to an outlet opening. Conveying means is provided to effect the displacement of the material through the chamber while above the transport path a distribution duct or pipe is provided with a multiplicity of spray nozzles.

Liquefied nitrogen is sprayed upon the product. The distribution duct or pipe forms, for example, a double loop which spans a relatively long portion of the transport path.

An important aspect of this system is that the spray zones of the nozzles overlap so that the total area occupied by the material is completely covered by the spray.

This spray system has, however, various disadvantages. For example, the long length of the distribution or manifold pipe permits a relatively large heat transfer from the freezing chamber to the distribution pipe and hence to the liquid nitrogen therein. As a consequence, the liquid nitrogen is converted from a single liquid phase to a two-phase mixture of gas and liquid.

The cooling capacity of a gas phase is significantly less than that of a liquid phase so that the discharge of the gaseous coolant into the chamber or against the material to be deep frozen can give rise to a slower cooling period operation.

In most of the cases described above, it is important to obtain a maximum rate of temperature reduction as it is to achieve the final reduced temperature and hence this earlier system is not fully satisfactory.

Efforts to overcome this disadvantage have been made and have involved, for example, efforts to reduce the quantity of gas which will be entrained with or will be present in the liquid phase. These systems effectively tend to limit the amount of a gas phase present in the liquid phase but have not been able to exclude the gas phase.

As a result of the substantially greater volume of the gas phase by comparison to the liquid phase, earlier systems have the additional disadvantage that the discharge through the nozzle of the liquid phase is disturbed; the throughput is disturbed especially where the nozzle throughput is low and the spray area of nozzle is restricted. In fact, the presence of a large-volume gas phase can also reduce the throughput of the liquid phase.

Another problem with earlier systems is that it is difficult to maintain long manifold or distribution pipes in precisely horizontal orientations. The precise horizontal lay of such pipes is especially important for the discharge of a liquid coolant containing a significant quantity of a gaseous phase. If a pipe of this type is not maintained precisely horizontal, the gas phase tends to accumulate at the higher locations of the distribution pipe and to interfere with a uniform discharge of the liquid phase. The cooling capacity of this system is thereby reduced. In extreme cases, only the gas phase may be discharged through the nozzles at the higher side of the distribution pipe assembly while only the liquid phase is sprayed from the remaining nozzles and uniformity of cooling is impossible to achieve. Frequently these earlier systems, in spite of the relatively high cost, large number of nozzles, and considerable spray area, cannot achieve a reproducible, satisfactory or complete deep freezing of the product.

OBJECTS OF THE INVENTION

It is the principal object of the present invention to provide an economical spraying system for a liquid cryogen which avoids the disadvantages enumerated above.

Another object of this invention is to provide a relatively low cost and simple apparatus for the contacting of a cryogen with a material to be deep frozen which ensures that the cryogen will be applied in its liquid form in an economical and efficient manner.

SUMMARY OF THE INVENTION

These objects and others which will become more readily apparent hereinafter are attained in accordance with the present invention, in which the device is provided with a distribution duct whose spray nozzles have slit-shaped, i.e. elongate, discharge orifices. Our invention, elucidated in greater detail below, is based upon the surprising discovery that, for a given discharge cross section (orifice cross section) slit-like or elongated orifices afford a significantly greater discharge rate, especially of liquid cryogens. The surprising relationship between the slit-like orifice and liquid cryogen such as liquid nitrogen, have been studied by us, but are not fully explainable at this point, since the effect appears to be less pronounced or even nonexistant with noncryogenic liquids such as water.

With the system of the present invention, therefore, in which the distribution duct is provided with nozzles having slit-shaped orifices, a larger spray angle with a higher throughput can be generated and problems hitherto plaguing the deep-freezing art can be eliminated.

A particular advantage is that the distribution duct can be relatively short, thereby minimizing the heat transfer from the freezing chamber to the cryogenic coolant and therefore sharply reducing the formation of a two-phase flow.

Comparisons of slit-like nozzles having the customary circular orifices are detailed below:

A circular-orifice nozzle tested with water at 20° C. at a spraying pressure of 3 bar gave a throughput of 3.10 liters/min. with a spray angle 120°. When, however, liquid nitrogen at the same pressure is sprayed from the same nozzle the throughput was 2.50 liters/min. and the spray angle was 25°.

When a slit-shaped orifice was provided of the same cross section and the nozzle was tested with water at 20° C. at a pressure of 3 bar, the throughput was again 3.10 liters/min. with a spray angle of 110°. With the liquid nitrogen, however, the spraying rate was practically the same, i.e. the throughput was 3.27 liters/min. and the spray angle about 105°, utilizing the pressure of 3 bar.

Thus by comparison with a conventional system utilizing a plurality of passes of the distribution pipe with circular cross section spray nozzles, a system of the present invention using slit-like orifices in the spray nozzle, allows a single distribution pipe pass to be used.

When the slit-like orifices are oriented transversely to the direction of travel of the material to be treated, the single row of nozzles can spray the full width of a conveyor band, while two rows of nozzles were required with circular section orifices. Obviously heat transfer to the liquid cryogen through the distribution pipe is markedly reduced with the system of the present invention.

Thus, while the throughput of the nozzle does not appear to materially change for noncryogenic fluids between the circular cross section and the elongated or slit-like cross section of the present invention, the use of a slit-like nozzle permits a much higher throughput of a liquid cryogen, especially nitrogen. Since the throughput per nozzle can be markedly increased, the number of nozzles which may be required for a certain total cooling effect can be reduced and thus one not only can reduce the length of the manifold tube but also can decrease the cost of the unit by eliminating an excessive number of nozzles and associated machining costs.

Another surprising advantage of the arrangement of the present invention is that the slit-like orifices appear to produce liquid droplets of larger diameter than is the case with nozzles of a lesser throughput. Since the total surface area of these droplets (per unit throughput) is smaller than is the case with more droplets of smaller diameter, evaporation losses prior to heat transfer to the material to be frozen can be reduced.

Still another advantage of the present system is its lack of sensitivity to different throughputs of liquids, to the presence of contaminants, and to the presence of gaseous phase.

This means that these variables do not have as great an effect upon the uniformity of freezing and the quality of the product.

Furthermore, the spraying system of the present invention can be a relatively simple structure which is highly effective in economically freezing practically all types of solids which have been quick-frozen heretofore, partly because the system applies a large amount of the liquid cryogen more rapidly than heretofore.

The consumption of the liquid cryogen for a given degree of cooling as measured at the product is reduced because of the economy factor discussed above and because of the rapid heat transfer obtained because of the large liquid droplets and reduced evaporation losses.

Finally the apparatus can be set up more quickly and efficiently for spraying different coolants and different products since the spraying zone can be reduced and the number of nozzles which must be changed is similarly diminished.

According to a feature of the invention, a phase separator is provided within the freezing chamber and is traversed by the liquid cryogen upstream of the manifold, the outlet of this phase separator being connected directly with the distributor pipe.

The phase separator of the present invention enables the gaseous phase to be rapidly and efficiently removed from the liquid phase, the liquid phase outlet communicating with the distribution pipe while the gas phase outlet is separate therefrom and thus ensures that practically only the liquid phase will reach the nozzles.

Since the phase separator is located within the freezing chamber, whose operating temperature is well below ambient, the separate insulation of the phase separator is not required and preferably no such insulation is used.

Naturally, it is desirable to make the path of the liquid through the phase separator and to the nozzles as small as possible and hence the liquid phase outlet and the distribution line are held as short as possible so the renewed development of the gaseous phase is minimized. Obviously this requirement is not only fully compatible with the use of the slit-like nozzles but the two work hand in hand to minimize the production of a two-phase mixture and the ensuing losses.

Advantageously, the gas-phase outlet of the separator also opens into the freezing chamber so that the cold content of the gas phase is not lost and can possibly contribute to the precooling of the product.

According to yet another feature of the invention, the phase separator has the configuration of a cylinder into which the inlet for the cryogen opens coaxially, i.e. along the cylinder axis.

Toward the bottom of the cylinder there is provided a frustoconically downwardly converging grate, screen or grid functioning as a filter for impurities which might tend to contaminate the nozzle. In principle this dirt collector can also be provided ahead of the separator although this may require additional insulation, a separate container and has related disadvantages. Best results are achieved when the dirt collector is integrated with the separator and is disposed immediately ahead of the nozzle so that even pipeline contaminants and dirt which arises close to the nozzle can be collected and prevented from entering the nozzles.

It has been found to be advantageous to surround the gas inlet with a gas permeable thermally conductive material, for example, copper wool, which prevents entrainment of the liquid with the gas phase.

The nozzle construction of the present invention can be formed by simply machining a V-section slit (long and narrow) nozzle body provided with a blind circular bore terminating short of the discharge end of the nozzle. When this slit has a V-section, a spray angle of 120° can be obtained when the depth of the groove is about 5/6 of the diameter of the feed bore so that the feed bore can project axially to $\frac{1}{3}$ the depth of the groove and can open in an hemispherical cavity into the groove. The depth of the groove should be about $\frac{1}{3}$ the latter diameter as well.

A further parameter which appears to be of significance is the divergence of the V groove, i.e. its apex angle, which should be between 20° and 40° for the deep freezing of foods where rapid freezing is vital. Naturally this angle will determine the width of the spray pattern as well.

According to another feature of the invention, the supply pipe opens into the cylindrical housing of the phase separator at an intermediate location over the height of the housing and a frustoconical disc is provided around the end of the pipe to delimit the lower end of an annular chamber defined between the pipe and the housing wall. This chamber is filled with the gas-permeable material, preferably copper wool, to minimize entrainment of droplets to the gas-phase outlet and to ensure a uniform heat distribution throughout this space. While copper wool is preferred, any other porous mass which is thermally conductive and has a high surface area can be used.

Preferably a constant liquid level in the phase separator should be maintained, this level being controlled by the back pressure at the gas-phase outlet. However, a contribution is made to the constancy of the liquid level by the packing, since a rise in the liquid level to the packing causes evaporation, pressure increase and a depression of the liquid level.

The phase separator described has been found to be particularly desirable because of its low cost and compact construction.

BRIEF DESCRIPTION OF THE DRAWING

The above and other objects, features and advantages of the present invention will become more rapidly apparent from the following description reference being made to the accompanying drawing in which.

SPECIFIC DESCRIPTION

Figure 3:
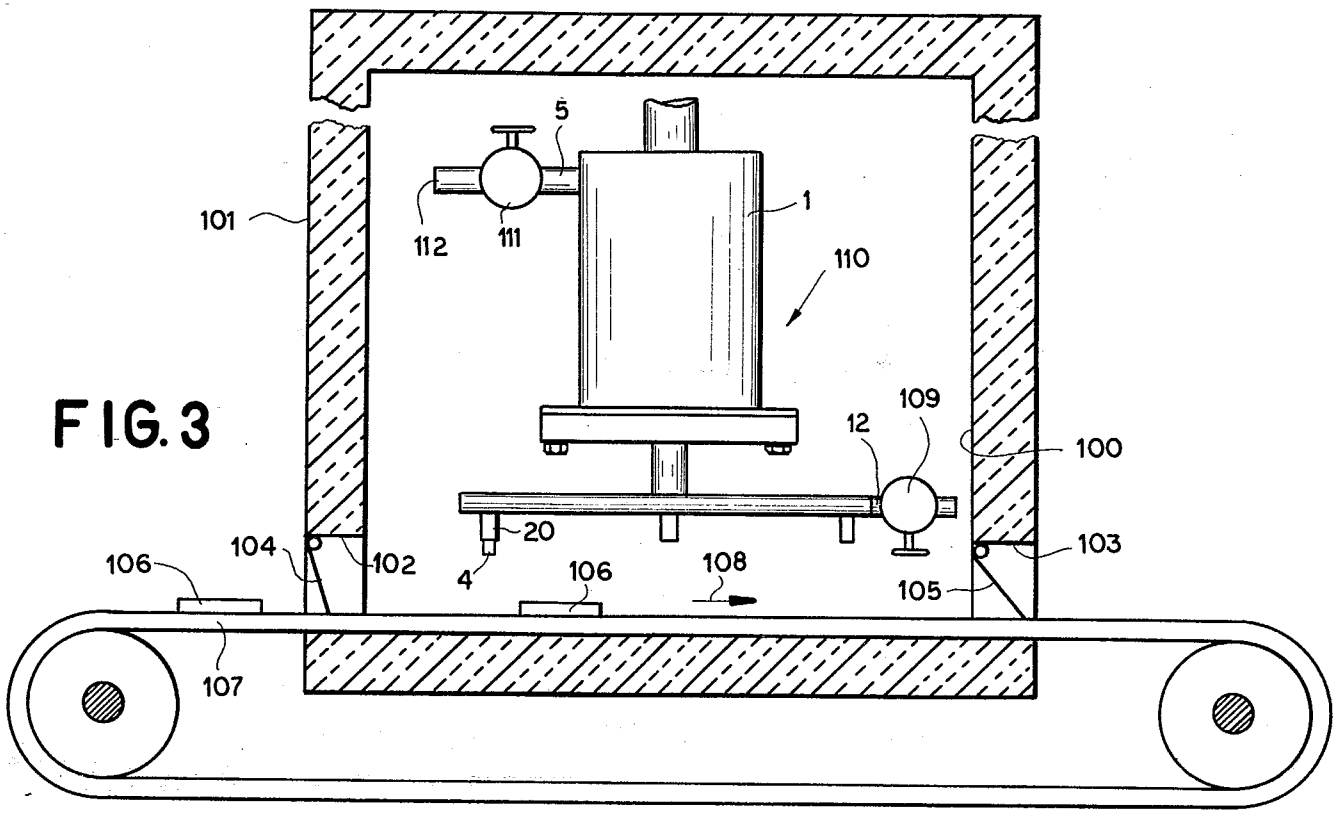
FIG. 3 is a diagrammatic vertical cross-sectional view through an apparatus for the deep freezing of foods in accordance with the present invention.

Referring first to FIG. 3, it can be seen that the deep freezing chamber 100 is defined within a thermally insulating enclosure 101, shown highly diagrammatically, and provided with an inlet 102 for the products to be frozen and an outlet 103. Conventional gates 104, 105, may be provided at the inlet and the outlet to permit a food product 106 to enter the chamber and the frozen product to be discharged.

Naturally, the chamber may be provided with sealable windows through which access may be afforded to the units therein, with vents for discharging excess gas and like devices conventional in the art.

Figure 1:
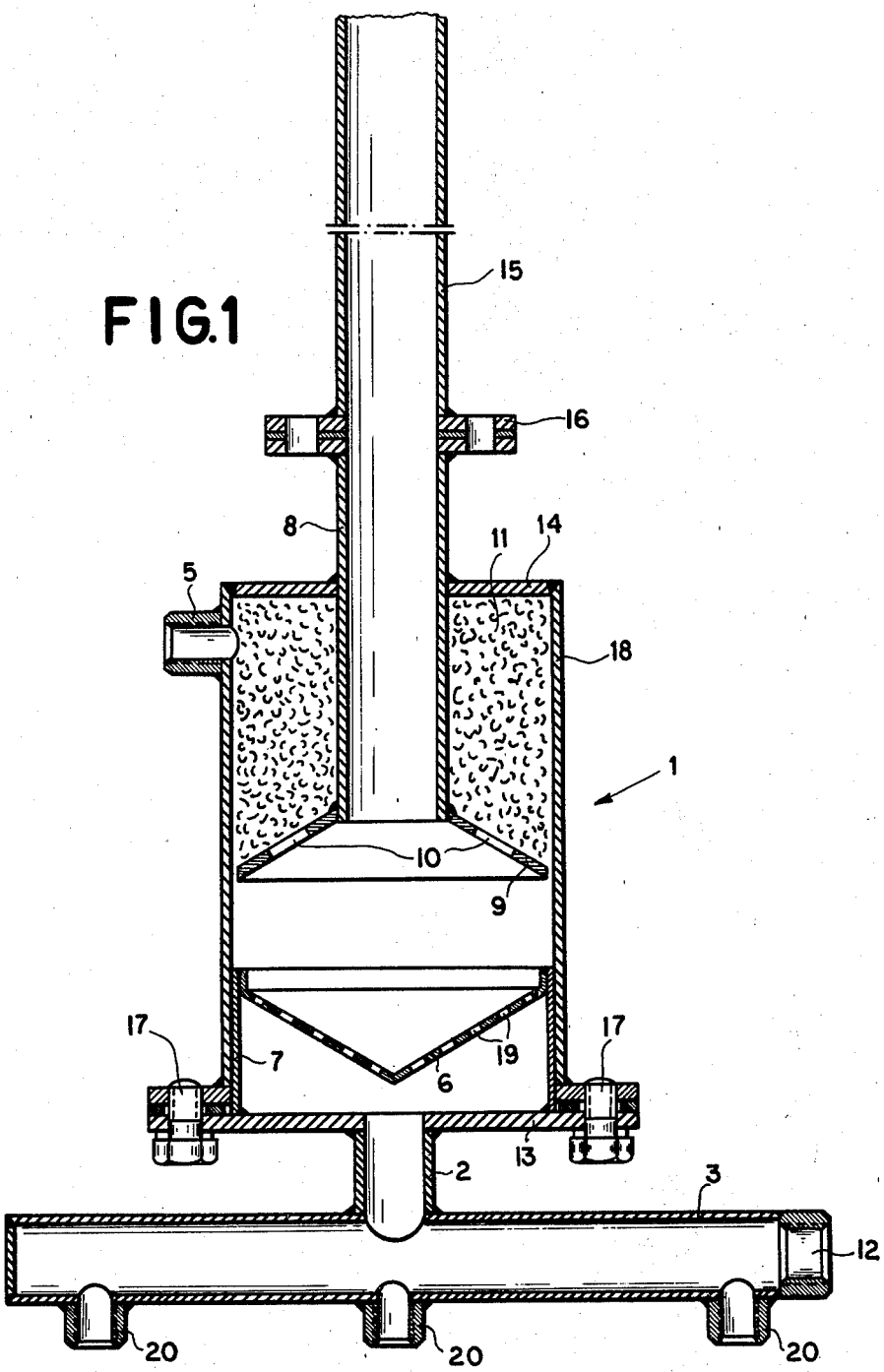
FIG. 1 is an axial cross-sectional view through phase separator and distribution system of the present invention.

A conveyor belt 107 passes through the chamber and carries the food products beneath a spray unit generally represented at 110 and shown in greater detail in FIG. 1. The nozzle fittings 20 are provided with respective nozzles 4 whose slits are oriented transverse to the direction of travel 108 of the food product. To the fitting 12 of the distribution pipe, there is connected a ball valve 109 while a further ball valve 111 is connected to a fitting 5 of the phase separator 1.

The phase separator 1 shown in FIG. 1 is substantially of circular cylindrical configuration and has an upper end wall 14 through which a feedpipe 8 for the liquid cryogen extends. This pipe is coaxial with the cylinder and extends therein to define an annular space.

A flange 16 can be used to connect a supply line 15 to the feed pipe 8.

At the end of the feed pipe 8 terminating in the cylinder, a downwardly widening frustoconical disc 9 is provided, the disc 9 having openings 10.

The annular space between the cylindrical wall 18 and the pipe 8, above the disc 9 and below the end 14 is filled with a porous packing of copper wool as shown at 11. The fitting 5 opens laterally from the annular chamber close to the tip of the cylinder and can receive the valve 11 and a nozzle 112 for discharging the gaseous phase into the chamber 100.

The bottom end of the phase separator is closed by the wall 13 in which an outlet fitting 2 is mounted, this outlet fitting being as short as possible and connecting a distribution pipe 3 to the liquid outlet of the phase separator.

The bottom wall 13 is connected by bolts 17 to an outwardly extending flange on wall 18. A cylindrical sleeve 7 is welded onto the plate 13 coaxial with the wall 18 and carries at its upper end a replaceable conical sieve or screen 6 forming a dirt catcher. The openings 19 in this screen are smaller than the openings in the nozzles to be described subsequently. Since the outer diameter of cylinder 7 corresponds to the inner diameter of the cylinder 18, no contaminating particles can pass from the phase separator to block the nozzles.

Figure 2A:
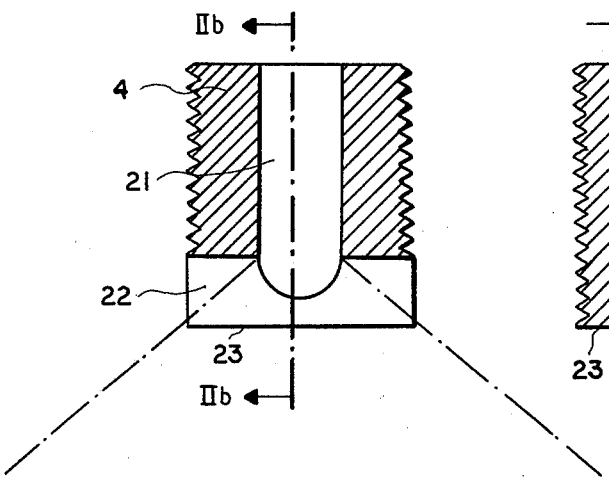
FIG. 2*a* is an axial cross-sectional view through a nozzle adapted to be used in the apparatus of FIG. 1.
Figure 2B:
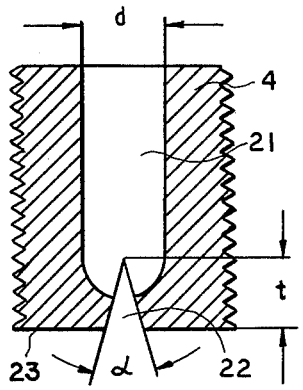
FIG. 2*b* is a cross-sectional view taken along the line II*b*—II*b* of FIG. 2*a;*
Figure 2C:
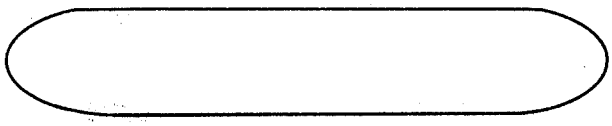
FIG. 2*c* is a diagram of the spray pattern of this nozzle.

The distribution pipe 3 has three fittings 20 which are internally threaded to engage the externally threaded spring nozzles 4 (FIGS. 2*a* and 2*b*). At one end of the pipe 3 a further threaded fitting 12 is provided to accommodate the ball valve 109.

The nozzles (FIGS. 2*a* and 2*b*) can be formed from cylindrical workpieces which are blind bored at 21 along the axis until the end of the bore 21 is spaced from the end 23 of the workpiece by about $\frac{1}{3}$ the diameter d of the bore.

While the end of the drill can have any shape, best results are obtained when it is hemispherical or of such shape as to form a hemispherical end to the bore.

The end of the workpiece is then milled with a V-section groove having an apex angle $\alpha$ of about 30° and a depth t of about 5/6 d, intersecting the end of the bore. The groove is here represented at 22 and the end of the workpiece at 23.

In operation, the nozzles 4 are screwed into the fittings 20, the valve 109 is opened to vent the gas phase until liquid nitrogen emerges from the phase separator. Initially, naturally, only gas emerges until the liquid nitrogen supplied by lines 15 and 18 sufficiently cools the chamber and the phase separator. The gaseous nitrogen also vents at 5 and through the nozzles 4.

When liquid nitrogen is detected at the valve 12, this valve is closed and the gas phase, stripped from liquid droplets, emerges from the nozzle 112 and fitting 5. By the selection of this nozzle cross section or the setting of valve 111, the height of the liquid level in the separator can be adjusted: the smaller the gas outflow cross section, the lower the liquid level and vice versa. The best results are obtained with the liquid level between the dirt collector 6 and the surface 9. This prevents entrainment of gas through pipes 2 and 3 or liquid contact with the copper wool. To clean the dirt catcher, to change the distributor or to otherwise have access to the interior of the separator, it is merely necessary to remove and replace the bolts 17.

We claim:

1. A deep freezing system comprising:

an insulated chamber adapted to receive a product to be deep frozen;

a distribution pipe provided with at least one spray nozzle for a liquid cryogen, said spray nozzle having a passage formed by a cylindrical bore for said liquid cryogen extending downwardly from said pipe, and a downwardly opening slit-shaped elongate long and narrow orifice formed by a V-section groove intersecting said bore for discharging a spray of the liquid cryogen onto said product; and means for feeding a liquid cryogen to said distribution pipe.

2. A deep freezing system as defined in claim 1, further comprising a phase separator connected to said distribution pipe for separating a gaseous phase from said liquid cryogen, said phase separator having a liquid-phase outlet connected directly to said pipe.

3. The system defined in claim 2 wherein said tube is formed at its end within said housing with a disc defining the bottom of said compartment and provided with throughgoing openings, said compartment being filled with a gas-permeable material.

4. The system defined in claim 2 wherein said phase separator has a gas-phase outlet opening into said chamber.

5. The system defined in claim 4 wherein said phase separator comprises a cylindrical housing, a tube extending axially into said housing and defining an annular compartment therein around said pipe, said liquid phase outlet being provided at the bottom of said housing and said housing containing a dirt collector disposed above said liquid-phase outlet.

6. The system defined in claim 5 wherein said compartment is filled with a gas-permeable packing.

7. The system defined in claim 6 wherein said gas-phase outlet opens into said compartment.

8. The system defined in claim 1 or 7 wherein said V-section groove has an apex angle of 20° to 40°.

9. The system defined in claim 8 wherein said slit is a groove having a depth $t=5/6\ d$ where d is the diameter of the bore.

10. The system defined in claim 9 wherein said bore terminates at a distance of approximately $\frac{1}{3}$ d from the end of the nozzle body in a hemispherical concavity.

11. The system defined in claim 1, claim 7 or claim 3, further comprising means for transporting said product through said chamber beneath said distribution pipe.

* * * * *